United States Patent [19]

Lisiecki

[11] Patent Number: 4,819,865

[45] Date of Patent: Apr. 11, 1989

[54] LOW STRESS FLAT END CLOSURE ARRANGEMENT FOR THERMOPLASTIC COATED PAPERBOARD CARTON

[75] Inventor: Robert E. Lisiecki, West Bloomfield, Mich.

[73] Assignee: Elopak Systems A.G., Walled Lake, Mich.

[21] Appl. No.: 261,638

[22] Filed: Oct. 24, 1988

Related U.S. Application Data

[63] Continuation of Ser. No. 129,661, Dec. 7, 1987, Pat. No. 4,785,993.

[51] Int. Cl.[4] ..... B65D 5/06; B65D 5/08

[52] U.S. Cl. ..... 229/137; 229/3.1; 229/125.15; 229/125.17

[58] Field of Search ..... 229/125.15, 125.17, 229/3.1, 132, 137, 138; 206/621.1, 621.2, 621.3, 621.7, 631.2, 631.3

[56] References Cited

U.S. PATENT DOCUMENTS

| | | | |
|---|---|---|---|
| 3,281,048 | 10/1966 | Koltz et al. | 206/631.2 |
| 3,327,920 | 6/1967 | Hynes et al. | 206/631.3 |
| 4,267,957 | 5/1981 | Holmstrom | 229/137 |
| 4,691,858 | 9/1987 | Peer, Jr. | 229/3.1 |
| 4,785,993 | 11/1988 | Lisiecki | 229/137 |

FOREIGN PATENT DOCUMENTS

| | | | |
|---|---|---|---|
| 197614 | 10/1986 | European Pat. Off. | 229/132 |
| 2176767 | 1/1987 | United Kingdom | 229/138 |

*Primary Examiner*—Stephen Marcus
*Assistant Examiner*—Gary E. Elkins
*Attorney, Agent, or Firm*—John P. Moran

[57] ABSTRACT

A flat end closure arrangement for a paperboard carton which may include an aluminum foil barrier, wherein there are no overstressed folds and a minimum buildup of thicknesses, to minimize the tendency for fractures of the respective barriers to occur. Two oppositely disposed closure panels include provisions for the edge portions of their center segments to overlap one another, while being covered by the remaining two oppositely disposed closure panels. More specifically, the underlying closure panels each includes score lines which coverage toward the respective free edges of the panels, while one includes one horizontal score line connecting two parallel vertical score lines which define the center segment for folding back onto the closure panel beneath the center segment of the other closure panel.

5 Claims, 4 Drawing Sheets

LOW STRESS FLAT END CLOSURE ARRANGEMENT FOR THERMOPLASTIC COATED PAPERBOARD CARTON

This is a continuation, of application Ser. No. 129,661, filed on Dec. 7, 1987, now U.S. Pat. No. 4,785,993 issued Nov. 22, 1988.

TECHNICAL FIELD

This invention relates generally to liquid-carrying, thermoplastic coated paperboard cartons and, more particularly, to a flat end closure therefor.

BACKGROUND ART

Heretofore, thermoplastic coated paperboard cartons having flat end closures of the in-folded and/or out-folded fin sealed types formed on opposite ends thereof have been used with generally satisfactory results. However, when the, so-called, in-folded type of end closure is used, several panel thicknesses are operative in the folding operations, the panel thicknesses result in crowding of layers, causing stretching or tensioning of the outermost layers around inner layers to the extent that some outermost layers tend to pull apart and crack, thereby destroying the liquid impermeable thermoplastic layer, producing bulging of the paperboard and subsequent leaking therethrough.

A typical in-folded bottom end closure is shown and described in Lisiecki U.S. Pat. No. 4,546,915, issued Oct. 15, 1985.

DISCLOSURE OF THE INVENTION

Accordingly, a general object of the invention is to provide an improved flat end closure for a thermoplastic coated paperboard carton, which may include an aluminum foil barrier, with no overstressed folds and minimum buildup of thicknesses, thereby minimizing the tendency to cause fractures of the individual layers which impairs the product quality.

Another object of the invention is to provide an improved flat end closure for a thermoplastic coated paperboard carton, wherein no in-folded fin seal is required.

A further object of the invention is to provide a flat end closure for a rectangular cross-section paperboard carton, wherein the two oppositely disposed wider closure panels fold toward one another, with provisions for the edge portions of their center segments overlapping one another and being partially covered by the two oppositely disposed narrower closure panels.

Still another object of the invention is to provide an alternative flat end closure for a rectangular cross-section paperboard carton, wherein the folded-together wider closure panels are completely covered by the two oppositely disposed narrower closure panels.

A still further object of the invention is to provide a blank for a flat end closure for a rectangular cross-section paperboard carton, wherein the widest closure panel consists of three sets of proportionately similar geometric configurations, forming six panel segments adaptable to being folded into six directions.

These and other objects and advantages of the invention will be more apparent when reference is made to the following drawings and the accompanying description.

BEST MODE OF CARRYING OUT THE INVENTION

Figure 1:
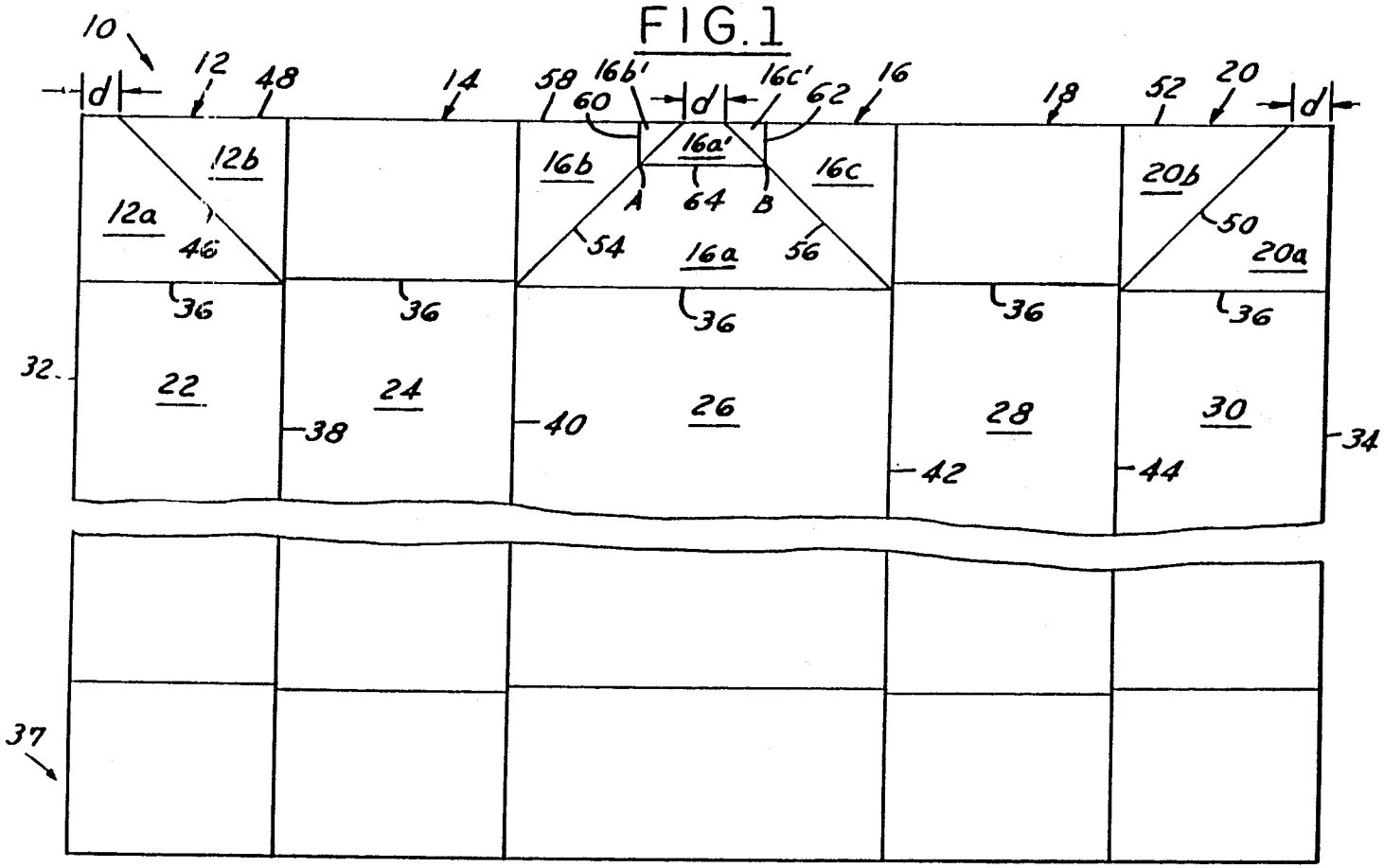
FIG. 1 is a fragmentary layout view of the outside surface of a thermoplastic coated paperboard container blank used to construct a container having an end closure in accordance with the present invention.

Referring now to the drawings in greater detail, FIG. 1 illustrates the bottom closure portion of a blank 10 including bottom closure panels 12, 14, 16, 18 and 20, and respective side panels 22, 24, 26, 28 and 30 between side edges 32 and 34, the two sets of panels being separated from each other by a staggered horizontal score line 36. A typical top closure arrangement 37. Vertical score lines 38, 40, 42 and 44 serve to separate, respectively, the panels 12 and 22 from the panels 14 and 24, the panels 14 and 24 from the panels 16 and 26, the panels 16 and 26 from the panels 18 and 28, and the panels 18 and 28 from the panels 20 and 30.

A score line 46 is formed diagonally across the bottom closure panel 12 from the intersection of the score lines 36 and 38 to the free edge 48 of the panel 12, defining in-fold panel segment **12*a* and a triangular fold-back panel segment 12b. A score line 50 is formed diagonally across the bottom closure panel 20 from the intersection of the score lines 36 and 44 to the free edge 52 of the panel 20, defining in-fold panel segment 20*a* and a triangular fold-back panel segment 20*b***.

Converging score lines 54 and 56 are formed on the bottom closure panel 16 from the respective intersections of the score line 36/40 and 36/42 to the free edge 58 of the panel 16, defining intermediate in-fold panel segment **16*a* and adjacent triangular fold-back segments 16*b* and 16*c*. The ends of the score line 54 and 56 at the free edge 58 are spaced apart a predetermined distance d, substantially equal to the distance of the ends of the score lines 46 and 50 from the respective edges 32 and 34, along the respective free edges 48 and 52. A pair of short, parallel score lines 60 and 62 are formed on the respective panel segment 16*b* and 16*c* from points A and B along the respective score lines 54 and 56 to the free edge 58. A score line 64 is formed laterally across the panel segment 16 a between the points A and B. The score lines 60, 62 and 64, in conjunction with the end portions of the score lines 54 and 56 define a segment 16*a* proportional to the segment 16*a*, a segment 16*b*** proportional to the segment 16*b*, and a segment 16*c*′ proportional to the segment 16*c*.

Figure 2:
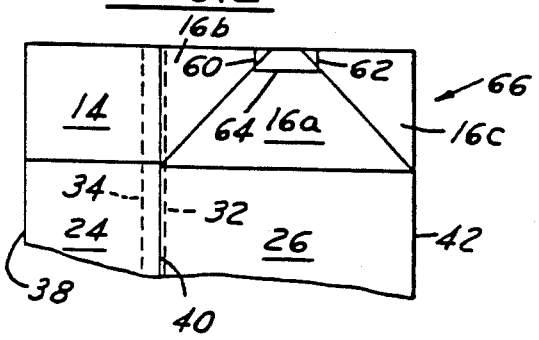
FIG. 2 is a fragmentary layout view of the outside surface of a container structure after it is side seamed from the container blank illustrated in FIG. 1.

As shown in FIG. 2, forming of a carton from the blank 10 begins with a so-called "flame sealer" machine folding the blank around the vertical score lines 38 and 42, and sealing together the overlapped edge portions of the panels 12/22 and 20/30 to form a sealed blank 66.

Figure 6:
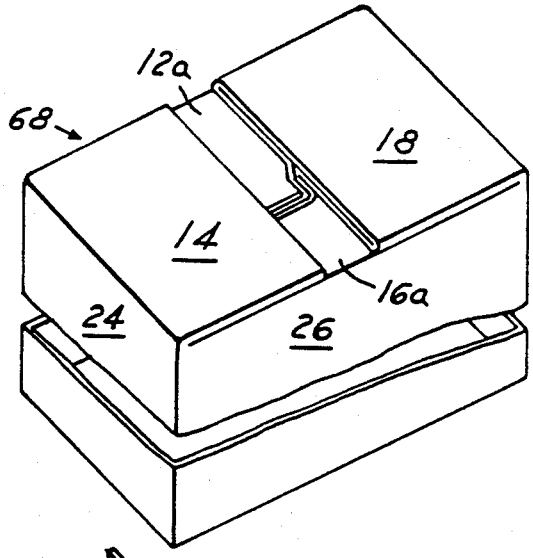
FIG. 6 is a fragmentary perspective view showing the container after the end closure has been sealed into a flat, completely closed condition.

The sealed blanks 66 are stacked in a magazine of a forming, filling and sealing machine, from which the blanks 66 are automatically removed one at a time and processed into a complete and filled carton whose bottom closure arrangement is as shown in FIG. 6.

Figure 3:
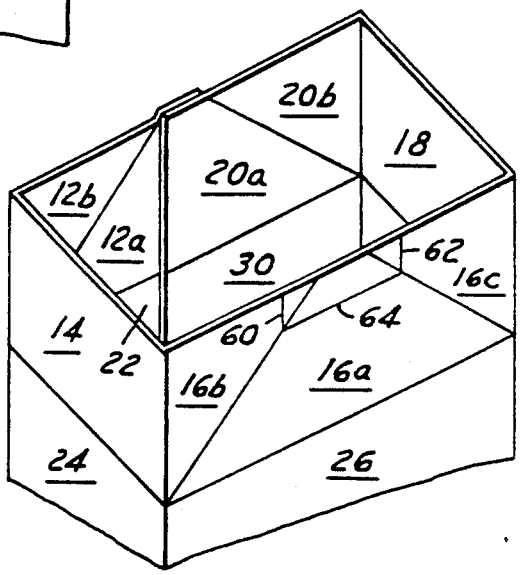
FIG. 3 is a fragmentary perspective view showing the side seamed container blank illustrated in FIG. 2 in an open ended condition prior to the closing of the end structure of the present invention.

The first step involves opening the flat blank 66 into a rectangular cross-section tube, as shown in FIG. 3. Thereafter, mechanical tucking fingers serve to urge the panel segment 16*a* and the combination of segments 12*a* and 20*a* inwardly toward each other. This action causes the segments 16*b*, 16*c*, 12*b* and 20*b* to fold around respective score line sets 54/40, 56/42, 46/32, and 50/44, as may be noted in FIG. 4.

Figure 4:
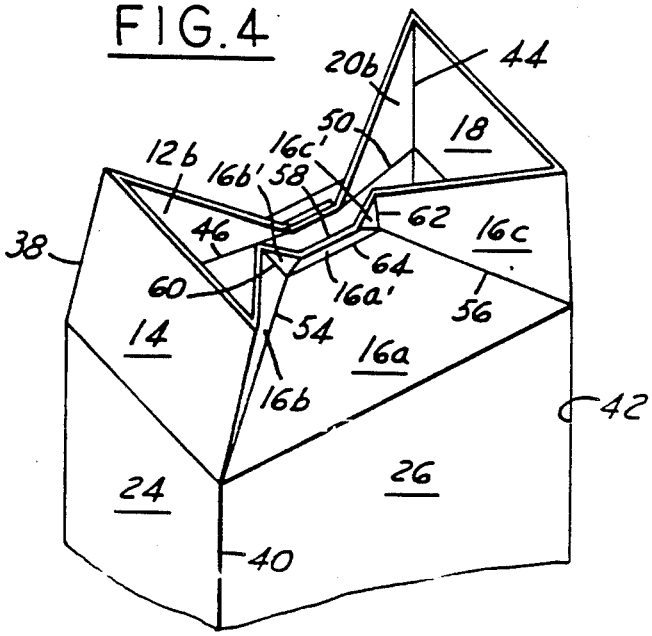
FIGS. 4 and 5 are fragmentary perspective views showing the end closure evolved from the blank of FIG. 3 in partially closed conditions.
Figure 5:
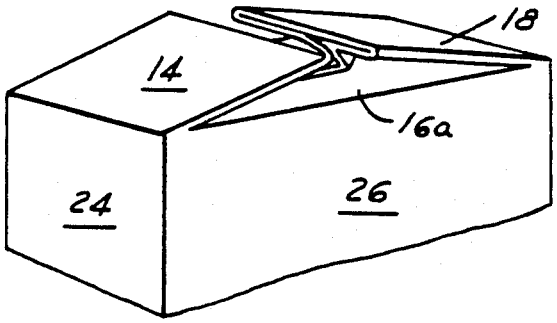

As a supplementary operation, the 16*a*′ portion of the segment 16*a* between the score line 64 and the free edge 58 is urged outwardly, causing the segment 16*a*′ to bend about the score lines 64, and the segments 16*b*′ and 16*c*′ to bend about the respective score lines 60 and 62, as also shown in FIG. 4. Continued pressure against the panel segments 16*a* and 12*a*/20*a* serves (1) to bring the upper overlapped edge portion of the 12*a*/20*a* combination into contact with the inner surface of the panel portion between the score line 64 and the free edge 58 for the distance d (FIG. 1); (2) to fold the outer surface of the panel segment 16*a*′ between the score line 64 and the free edge 58 onto the in-fold panel segment 16*a*; and (3) to fold the segment 16*b*′ of the fold-back segment 16*b* in between the adjacent portions of segments 16*b* and 12*b*, with segment 12*b* folded onto segment 12*a*, and the segment 16*c*′ of the segment 16*c* in between the adjacent portions of segments 16*c* and 20*b*, with segment 20*b* folded onto segment 20*a*; as may be realized from the FIG. 4 and FIG. 5 illustrations.

As a final step in the operation, the outer full bottom closure panels 14 and 18 are pressed flat under heat and pressure by a suitable pressure plate, resulting in their being sealed against the respective fold-back panel segment sets 12*b*/16*b* and 16*c*/20*b* producing the completed bottom closure 68 shown in FIG. 6.

Figure 7:
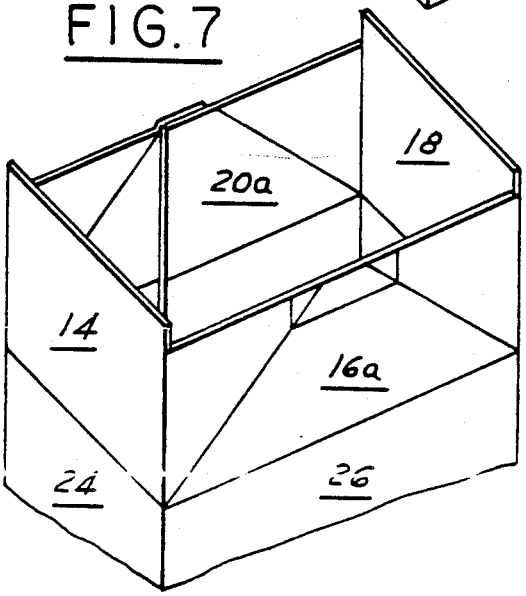
FIGS. 7 and 8 are fragmentary perspective views similar to FIGS. 3 and 6, respectively, showing an alternate embodiment of the invention.
Figure 8:
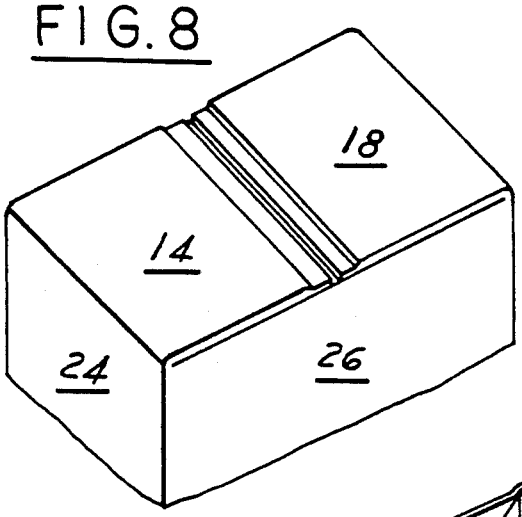

Referring now to FIGS. 7 and 8, it may be noted that the panels 14 and 18 have been formed longer than shown in FIG. 1, each by an amount equal to one-half the space between the panels 14 and 18 in FIG. 6. This serves to result in the more cosmetically acceptable looking exterior shown in FIG. 8, as compared to the exterior appearance of the FIG. 6 closure arrangement.

Figure 9:
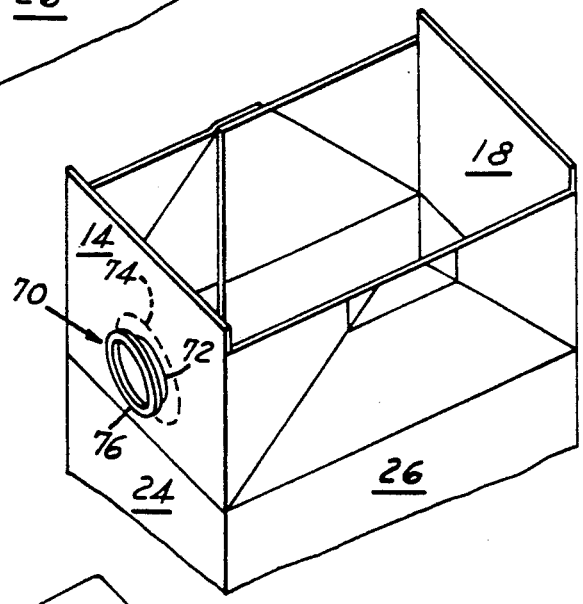
FIGS. 9 and 10 are fragmentary perspective views similar to FIGS. 7 and 8, respectively, showing a second alternate embodiment of the invention.
Figure 10:
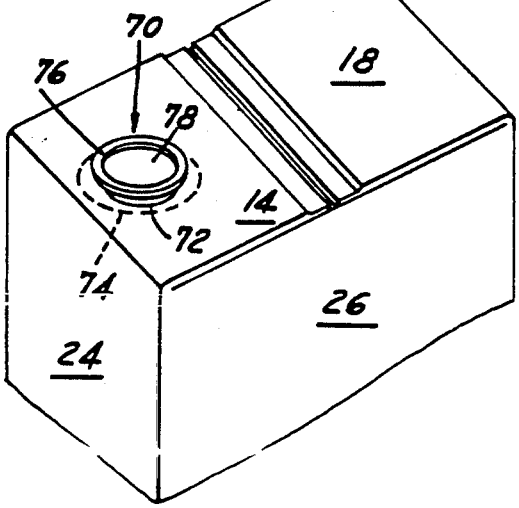

While the arrangements shown in FIGS. 6 and 8 are generally bottom closure arrangements, as is often the case, various closed end arrangements may be used as either a bottom closure or a top closure. If desired the closure arrangement described above may serve as a top closure where it need not be manually separated to form a pouring opening. FIGS. 9 and 10 include an auxiliary closure 70 which may be mounted in an opening 72 formed in the outer closure panel 14, and including a flange portion 74 sealed to the inner surface of the panel 14 around the opening 72. A flanged spout 76 extends beyond the outer surface of the panel 14. The central portion 78 may be punctured when it is desired to pour or insert a straw therethrough.

INDUSTRIAL APPLICABILITY

It should be apparent that the above described flat end closure arrangement provides an efficient closure with no need for fin seals, and wherein there are no overstressed folds and minimum buildup of thicknesses.

While but one general embodiment has been shown and described, other modifications thereof are possible within the scope of the following claims.

The embodiments of the invention in which an exclusive property or privilege is claimed are defined as follows:

1. In a thermoplastic coated paperboard container for carrying liquids, said container having four side wall panels, and opposite end closures, the improvement involving one of said end closures and comprising oppositely disposed inner panels, each having score lines converging from one side thereof toward the other and defining a central folded-in panel segment and two adjacent folded-back panel segments, and a central folded-back portion formed on only one of said central folded-in panel segments adjacent said other side thereof and sealed intermediate said one of said central folded-in panel segments and an end portion of the other of said central folded-in panel segments; and oppositely disposed outer panels, each overlapping and secured to a pair of folded-back panel segments, said pair consisting of one folded-back panel segment of each inner panel.

2. The improvement described in claim 1, wherein said central folded-back portion is defined by two score lines extending from the respective converging score lines outwardly to said other side of the inner panel parallel to each other, and a score line connecting between said parallel score lines at their junctures with said converging score lines.

3. The improvement described in claim 2, and oppositely disposed diagonal score lines extending from the respective junctures of said parallel score lines and said converging score lines to said other side of the inner panel.

4. The improvement described in claim 3, wherein said oppositely disposed diagonal score lines are converging and serve as continuations of said score lines defining said only one of said central folded-in panel segments.

5. In a thermoplastic coated paperboard container for carrying liquids, said container having four side wall panels interconnected by vertical score lines, and opposite end closures, each having four end closure panels connected via horizontal score lines to respective ends of the four side wall panels and to each other by extensions of said vertical score lines, with the distal ends thereof constituting a free edge; the improvement involving one of said end closures and comprising oppositely disposed inner panels, each having score lines converging from the corners thereof adjacent said side wall panels toward said free edge and defining a central folded-in panel segment and two adjacent folded-back panel segments, and a folded-back segment defined by two score lines formed on only one of said inner panels and extending from the respective converging score lines thereon to said free edge thereof parallel to each other and to said vertical score lines, and a score line connecting between said parallel score lines at their junctures with said converging score lines, with a portion of said folded-back segment being sealed intermediate the adjacent central folded-in panel segment and the end portion of the other central folded-in panel segment; and oppositely disposed outer panels, each overlapping and secured to a pair of folded-back panel segments, said pair consisting of one folded-back panel segment of each inner panel.

* * * * *